United States Patent [19]

Barnhart et al.

[11] 4,240,544

[45] Dec. 23, 1980

[54] COIN HOLDER

[76] Inventors: Kenneth O. Barnhart, 13231 Flower, Garden Grove, Calif. 92640; Lawrence H. Morita, 20212 Big Bend Lane, Huntington Beach, Calif. 92646; Rube I. Rubell, 4051 Manzanita, Irvine, Calif. 92714

[21] Appl. No.: 27,619

[22] Filed: Apr. 6, 1979

[51] Int. Cl.[3] ..... B65D 85/00

[52] U.S. Cl. ..... 206/0.82; 220/4 E

[58] Field of Search ..... 206/0.8, 0.82–0.84, 206/461–463, 470–471; 220/4 B, 4 E, 339; 229/2.5 R, 93

[56] References Cited

U.S. PATENT DOCUMENTS

| | | | |
|---|---|---|---|
| D. 148,685 | 2/1948 | Foier | 206/0.83 X |
| 189,939 | 4/1877 | Huested | 206/0.82 |
| 2,798,784 | 7/1957 | Marshall | 220/4 E |
| 3,127,009 | 3/1964 | Feis et al. | 206/0.80 |
| 3,367,483 | 2/1968 | Studen | 206/379 |
| 3,420,359 | 1/1969 | Cochrane | 206/0.82 |
| 3,923,152 | 12/1975 | Minneman | 220/339 X |
| 4,139,093 | 2/1979 | Holmes | 206/0.82 |

FOREIGN PATENT DOCUMENTS

| | | | |
|---|---|---|---|
| 219479 | 8/1957 | Australia | 206/0.82 |
| 262142 | 5/1968 | Austria | 206/0.80 |
| 595497 | 4/1960 | Canada | 206/0.82 |
| 800835 | 12/1968 | Canada | 220/339 |
| 598735 | 10/1959 | Italy | 206/0.83 |
| 455468 | 10/1936 | United Kingdom | 206/0.82 |

*Primary Examiner*—Stephen Marcus
*Attorney, Agent, or Firm*—Gordon L. Peterson

[57] ABSTRACT

A coin holder for a stack of coins of a predetermined diameter comprising first and second housing sections of transparent plastic sheet material hinged together along one of the longitudinal edges of the housing sections so that the housing sections can be moved between open and closed positions. The housing sections are resilient and have an inside diameter less than the diameter of the coins to be received therein so that the housing sections resiliently grip the coins. The plastic sheet material of the housing sections is formed inwardly at predetermined regions to define a plurality of radially, inwardly projecting and circumferentially extending ribs.

7 Claims, 5 Drawing Figures

COIN HOLDER

BACKGROUND OF THE INVENTION

This invention relates to a coin holder or coin wrapper of the type used by banks and other business establishments for holding a predetermined number of coins. Coin holders of this type facilitate the transport of the coins and the counting of the coins in that each coin holder will hold only a predetermined number of coins.

Perhaps the most common coin holder of this type is a paper wrapper in the form of a tube. However, it is difficult to load coins into the paper wrappers and, because of the opaque nature of the paper, persons handling the coin wrapper cannot readily ascertain whether it contains the requisite number of coins or a mixture of coins and slugs.

Preformed plastic coin holders are known and one such coin holder is shown in Cochrane U.S. Pat. No. 3,420,359. This coin holder includes a receptacle in the shape of a major section of a cylinder, and it is difficult to load the coins into the receptacle through the relatively narrow passage at the upper end of the receptacle. It is also necessary to provide special closure means to keep the closure of the receptacle in the closed position. A similar coin holder constructed of paper is shown in Chope U.S. Pat. No. 527,266.

SUMMARY OF THE INVENTION

This invention generally overcomes the disadvantages noted above with prior art coin holders. With this invention, coins can be easily inserted into the coin holder and, once inserted, the coins are resiliently retained in position. Also, the resilient gripping action of the coin holder on the coins tends to maintain the coin holder in the closed position and so no separate snap closure mechanism needs to be provided.

The coin holder of this invention can advantageously include first and second housing sections of plastic sheet material with each of the housing sections having opposite longitudinal edges. To facilitate loading of the coins into either of the housing sections, each of the housing sections preferably includes at least one essentially cylindrical half section.

Hinge means hingedly joins the housing sections together along one of the opposite longitudinal edges of each of the housing sections. This permits the housing sections to hingedly move between open and closed positions.

The coin holder is adapted to receive coins of a predetermined diameter when the housing sections are in the open position. The coin holder includes end walls for essentially blocking movement of the coins out of the ends of the coin holder at least when the housing sections are in the closed position.

At least the first housing section is resilient and has an inside diameter less than the diameter of the coins to be carried by the coin holder. Accordingly, the first housing section resiliently grips the coins even in the open position of the housing sections. This enables the thin sheet material of the coin holder to better retain the coins therein. Preferably, both of the housing sections are resilient and have an inside diameter less than the diameter of the coins to be received in the coin holder. In this event, both of the housing sections tend to resiliently grip the coins with the result that this gripping action tends to releasably maintain the housing sections in the closed position. Of course, additional means, such as tape, rubber bands, etc., may be used to more positively retain the housing sections in the closed position.

The plastic sheet material of each of the housing sections is preferably formed inwardly at predetermined regions to define a plurality of radially, inwardly projecting and circumferentially extending ribs with the adjacent ribs being spaced apart in even multiples of the thickness of the coins to be received in the coin holder. These ribs provide several important advantages. For example, the ribs materially stiffen the thin plastic sheet material of the housing sections. The ribs also tend to retain the coins against axial shifting in the coin holder to provide a sturdier stack of coins. Also, by making the housing sections transparent, or partially transparent, and by appropriately spacing the ribs an even multiple of coin thicknesses, they can serve as indicators of the number of coins in the coin holder.

The thin, plastic sheet material of the housing sections can be strengthened in other ways. For example, each of the housing sections has transverse edges, and lips or flanges may be provided along the transverse edges and on the longitudinal edges remote from the hinge. These lips also resist tearing of the plastic sheet material.

Although the hinge can take different forms, it can be advantageously formed of plastic sheet material, and it integrally joins the housing sections together along a selected longitudinal edge of the housing sections. The hinge includes a longitudinal fold in the plastic sheet material. The end portions of the fold can be relieved to eliminate the sharp edges that would otherwise exist at the opposite ends of the fold.

The coin holder of this invention can be sized to receive any desired size of coin. The coin holder may be adapted to receive one or more rows of coins of the same or different sizes. To provide for multiple rows, each of the housing sections preferably includes two or more essentially cylindrical half sections with the half sections of the first and second housing sections cooperating to define multiple coin receiving spaces.

The invention, together with further features and advantages thereof, may best be understood by reference to the following description taken in connection with the accompanying illustrative drawing.

DESCRIPTION OF THE PREFERRED EMBODIMENT

Figure 1:
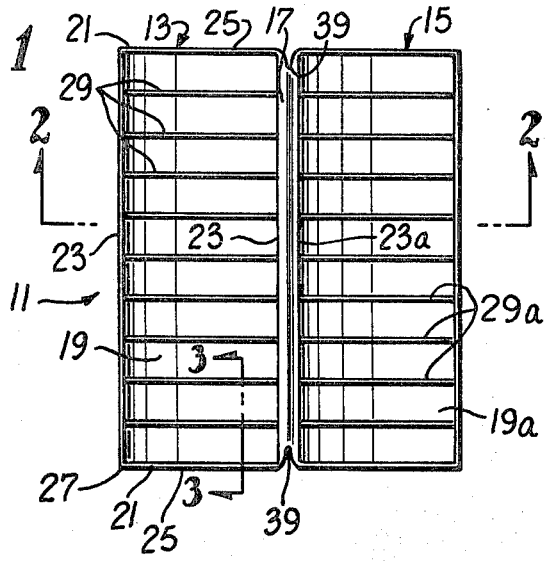
FIG. 1 is a top plan view of a coin holder constructed in accordance with the teachings of this invention with the coin holder being in the open position.

FIG. 1 shows a coin holder 11 which is integrally constructed of thin, plastic sheet material. The plastic material of the coin holder is preferably transparent or translucent so that it can be seen through. The plastic material is resilient and somewhat flexible.

Generally, the coin holder 11 comprises identical housing sections 13 and 15 integrally joined by a hinge 17. Because the housing sections 13 and 15 are identical, only the housing section 13 is described in detail herein and corresponding reference numerals followed by the letter "a" are utilized to designate corresponding portions of the housing section 15.

The housing section 13 is in the form of a hollow, cylindrical half section, and it includes a peripheral wall section 19 which is essentially in the form of a half cylinder and semi-circular end wall sections 21 which close the opposite ends of the peripheral wall section 19. The housing section 13 has opposite longitudinal edges 23 and opposite transverse edges 25. The hinge 17 is integrally joined to one of the longitudinal edges 23, and a continuous, integral lip or flange 27 extends continuously along the other longitudinal edge 23 and both of the transverse edges 25. For example, the lip 27 may project outwardly, i.e., have a width of from 0.008 to 0.010 inch.

Figure 3:
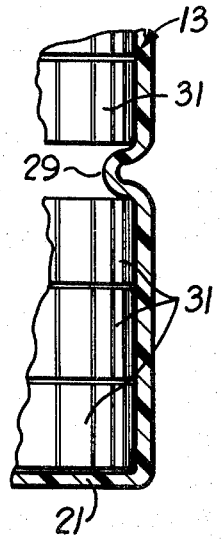
FIG. 3 is an enlarged, fragmentary sectional view taken generally along line 3—3 of FIG. 1 with the size of the inwardly projecting rib being greatly exaggerated for clarity.

The plastic sheet material of the housing section 13 is formed inwardly at axially spaced regions to define a plurality of radially, inwardly projecting and circumferentially extending ribs 29 (FIGS. 1 and 3). Although various constructions are possible, the rib 29 extends circumferentially for approximately 180 degrees and lies in a plane perpendicular to the longitudinal axis of the housing section 13.

The coin holder 11 is adapted to receive coins 31 (FIG. 3) of predetermined diameter and thickness. The ribs 29 are preferably equaly spaced axially along the housing section 13 an even multiple of the thickness of the coins 31. The inside diameter of the housing section 13 is less than the diameter of the coins 31. The housing section 13 is resilient so that the coins 31 are resiliently gripped even in the open position.

Figure 4:
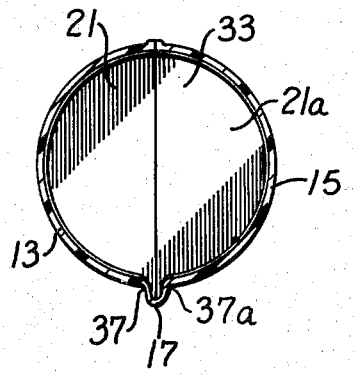
FIG. 4 is an end elevational view of the coin holder in the closed position.

The hinge 17 integrally joins adjacent longitudinal edges 23 and **23*a* of the housing sections 13 and 15, respectively. This enables the housing sections 13 and 15 to be hingedly moved between an open position in which the interiors of both of the housing sections 13 and 15 are fully exposed as shown in FIG. 1 and a closed position in which the housing sections cooperate to define a substantially fully enclosed coin receiving space 33 (FIG. 4). With the housing sections in the closed position, the end wall sections 21 and 21*a* cooperate to completely close the opposite ends of the coin holder and fully block movement of the coins 31 out the ends of the coin holder. The peripheral wall sections 19 and 19*a* form substantially all of the peripheral wall of the coin holder 11, with the hinge 17 forming only a small portion of the peripheral wall. The ribs 29 and 29*a* are in alignment as shown in FIG. 1 so that in the closed position, each of the ribs 29 cooperates with a corresponding one of the ribs 29*a* to define a rib which extends substantially completely around the coin holder. The ribs 29 and 29*a* do not extend through the hinge 17**.

Although the hinge 17 can be of various different constructions, in the embodiment illustrated, it includes a longitudinal fold 35 in the plastic sheet material of the hinge and longitudinal bend regions 37 and **37*a* (FIGS. 2 and 4) integrally joining the hinge 17 to the longitudinal edges 23 and 23*a*, respectively. The hinge 17 allows hinged movement of the housing sections 13 and 15 in that the bend regions 37 and 37*a* flex or bend longitudinally along their length and the fold 35 tends to open and close. The opposite end portions of the hinge 17 are relieved, or cut away, to form notches 39 (FIG. 1) which eliminates the otherwise protruding sharp end portions that would exist on the hinge 17**.

Figure 2:
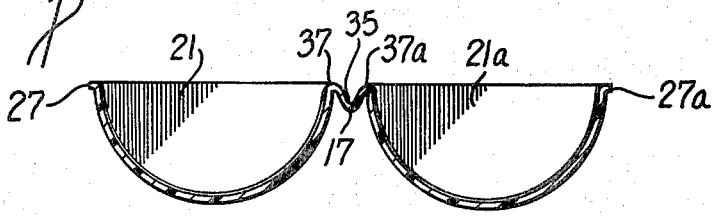
FIG. 2 is an enlarged, sectional view taken generally along line 2—2 of FIG. 1.

In use, the coins 31 are inserted into the housing section 13 or the housing section 15 when the coin holder is in the open position of FIGS. 1 and 2. The resilient housing sections 13 and 15 are undersized relative to the coins 31 and tend to resiliently grip the coins as they are inserted therein. When the coin holder is closed as shown in FIG. 4, both of the housing sections 13 and 15 resiliently grip the coins 31, and this tends to releasably hold the housing sections closed.

The ribs 29 and **29*a* stiffen the coin holder, serve as indicators as to the number and/or monetary value of the coins in the coin holder and tend to stabilize the stack of coins in the coin holder. In this regard, the spacing between adjacent coins 31 on opposite sides of the rib 29 is exaggerated for clarity. The coin holder may be more positively retained in the closed position by other means, such as a rubber band, tape, etc. Because the plastic material of the coin holder is transparent, the use of slugs in lieu of coins can be readily visually detected. In the open position, the coin holder 11** can be nested within identical coin holders.

Figure 5:
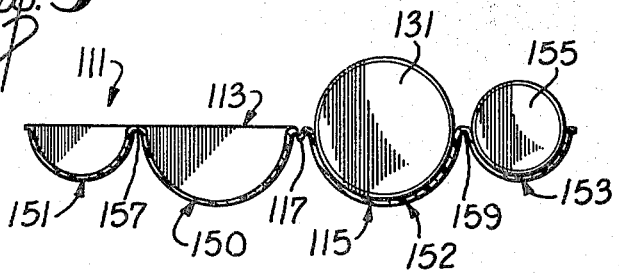
FIG. 5 is a sectional view similar to FIG. 2 of a second form of coin holder constructed in accordance with the teachings of this invention.

FIG. 5 shows a coin holder 111 which is identical to the coin holder 11, except that each of the housing sections 113 and 115 includes multiple cylindrical half sections 150, 151, 152 and 153, respectively. Portions of the coin holder 111 corresponding to portions of the coin holder 11 are designated by corresponding reference numerals preceded by the numeral "1." The half sections 150 and 152 are identical to the half sections of the housing sections 13 and 15, respectively. The half sections 151 and 153 are identical to each other and are identical to the half sections 150 and 152, except that they are of smaller diameter and, therefore, adapted to receive coins 155 of smaller diameter than the coins 131. Webs 157 and 159 integrally join the half sections 151 and 153 to the half sections 150 and 152, respectively. Of course, the half sections 151 and 153 can be of the same diameter or a larger diameter than the half sections 150 and 152. In the closed position of the coin holder 111, the half sections 151 and 153 cooperate to define a coin receiving space which retains the coins 155 in the same manner described above with reference to FIGS. 1–4.

The coin holders 11 and 111 can be manufactured in various different ways. For example, the coin holders of this invention are adapted to vacuum molding.

Although exemplary embodiments of the invention have been shown and described, many changes, modifications and substitutions may be made by one having ordinary skill in the art without necessarily departing from the spirit and scope of this invention.

We claim:

1. A coin holder for a stack of coins of predetermined diameter and predetermined thickness, said coin holder comprising:

first and second housing sections of plastic sheet material, each of said housing sections having opposite longitudinal edges, each of said housing sections including an essentially cylindrical half section;

hinge means for hingedly joining said housing sections together along one of said opposite edges of each of said housing sections whereby said housing sections can be hingedly moved between open and closed positions, said half sections cooperating in said closed position to define a coin receiving space, said coin holder being adapted to receive the coins of predetermined diameter when said housing sections are in said open position;

at least one of said housing sections including end wall means for essentially blocking movement of the coins out of the ends of the coin holder at least when the housing sections are in said closed position;

said half sections of said first and second housing sections being resilient;

the inside diameters of said half sections of said first and second housing sections being less than said predetermined diameter whereby the resilient gripping of the coins in the coin holder by said half sections tends to maintain said housing sections in the closed position when coins are in the coin holder; and the plastic sheet material of said housing sections being formed inwardly at predetermined regions to define a plurality of radially inwardly projecting and circumferentially extending ribs with adjacent ribs being spaced apart in even multiples of said predetermined thickness, each adjacent pair of said ribs being adapted to have a predetermined number of the coins therebetween.

2. A coin holder as defined in claim 1 wherein each of said housing sections is sufficiently transparent so that the coins in the coin holder can be visually observed in the closed position of the housing sections whereby said ribs also serve as indicators.

3. A coin holder as defined in claim 1 wherein said hinge means is formed of plastic sheet material and integrally joins said one opposite edges of said housing sections, said hinge means includes a longitudinal fold in the plastic sheet material of said hinge means, the end portions of said fold being relieved to eliminate sharp edges on the fold.

4. A coin holder as defined in claim 1 wherein each of said housing sections has transverse edges and flange means on said transverse edges and on the longitudinal edges of the housing sections remote from said hinge means, said flange means includes first and second flanges on the longitudinal edges of the first and second housing sections, respectively.

5. A coin holder as defined in claim 1 wherein each of said first and second housing sections includes a plurality of essentially cylindrical half sections, said half sections of said first housing section cooperating with said half sections of said second housing section in said closed position to define, respectively, a plurality of side-by-side coin receiving spaces.

6. A coin holder assembly comprising:

a stack of coins of predetermined diameter and predetermined thickness;

first and second housing sections of plastic sheet material, each of said housing sections having opposite longitudinal edges, each of said housing sections including an essentially cylindrical half section;

hinge means for hingedly joining said housing sections together along one of said opposite edges of each of said housing sections whereby said housing sections can be hingedly moved between open and closed positions, said half sections cooperating in said closed position to define a coin receiving space, said coin holder receiving the coins of predetermined diameter when said housing sections are in said open position;

at least one of said housing sections including end wall means for essentially blocking movement of the coins out of the ends of the coin holder at least when the housing sections are in said closed position;

said half sections of said first and second housing sections being resilient; and the inside diameters of said half sections of said first and second housing sections being less than said predetermined diameter so that the resilient gripping of the coins by the housing sections tends to maintain the housing sections in the closed position.

7. A coin holder assembly as defined in claim 6 wherein each of said housing sections is sufficiently transparent so that the coins in the coin holder can be visually observed in the closed position of the housing sections whereby said ribs also serve as indicators, each of said housing sections has transverse edges and non-interlocking flange means on said transverse edges and the longitudinal edges of the housing sections remote from said hinge means.

* * * * *